US010100481B2

(12) United States Patent
Karl et al.

(10) Patent No.: US 10,100,481 B2
(45) Date of Patent: Oct. 16, 2018

(54) GROUND-WORKING MACHINE AND METHOD FOR PRODUCING WALL PANELS

(71) Applicant: BAUER Spezialtiefbau GmbH, Schrobenhausen (DE)

(72) Inventors: Herbert Karl, Osterham (DE); André Seidel, Donauwoerth (DE); Mario Perconti, Brunnen (DE); Albert Rieblinger, Lerchen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 15/583,840

(22) Filed: May 1, 2017

(65) Prior Publication Data

US 2017/0335535 A1 Nov. 23, 2017

(30) Foreign Application Priority Data

May 17, 2016 (EP) ..... 16169918

(51) Int. Cl.
*E02D 3/12* (2006.01)
*E02D 5/18* (2006.01)
*E02D 17/13* (2006.01)

(52) U.S. Cl.
CPC ..... *E02D 5/18* (2013.01); *E02D 3/126* (2013.01); *E02D 5/187* (2013.01); *E02D 17/13* (2013.01)

(58) Field of Classification Search
CPC ..... E02D 3/126; E02D 5/187; E02D 3/12
See application file for complete search history.

(56) References Cited

U.S. PATENT DOCUMENTS 4,906,142 A * 3/1990 Taki ..... E02D 3/126 405/233
5,118,223 A * 6/1992 Taki ..... E02D 3/126 405/129.8
5,368,415 A 11/1994 Kono et al.
5,575,345 A 11/1996 Shibasaki et al.

FOREIGN PATENT DOCUMENTS

DE 102 38 646 B3 4/2004
EP 2 395 153 B1 3/2013

OTHER PUBLICATIONS

The extended European search report issued by the European Patent Office dated Jul. 21, 2016, which corresponds to EP16 16 9918.

* cited by examiner

*Primary Examiner* — Sean D Andrish
(74) *Attorney, Agent, or Firm* — Studebaker & Brackett PC

(57) ABSTRACT

The invention relates to a ground-working machine and a method for producing wall panels, with the ground-working machine having at least two elongate drilling and mixing tools arranged parallel to each other, which comprise a rod-form base body, on which a first screw conveyor and at least one second screw conveyor are arranged, the second screw conveyor being axially spaced apart from the first screw conveyor. According to the invention it is provided that at least on one drilling and mixing tool at a lower end the first screw conveyor is formed with an outer diameter that is greater than an outer diameter of the second screw conveyor which is arranged above the first screw conveyor.

11 Claims, 1 Drawing Sheet

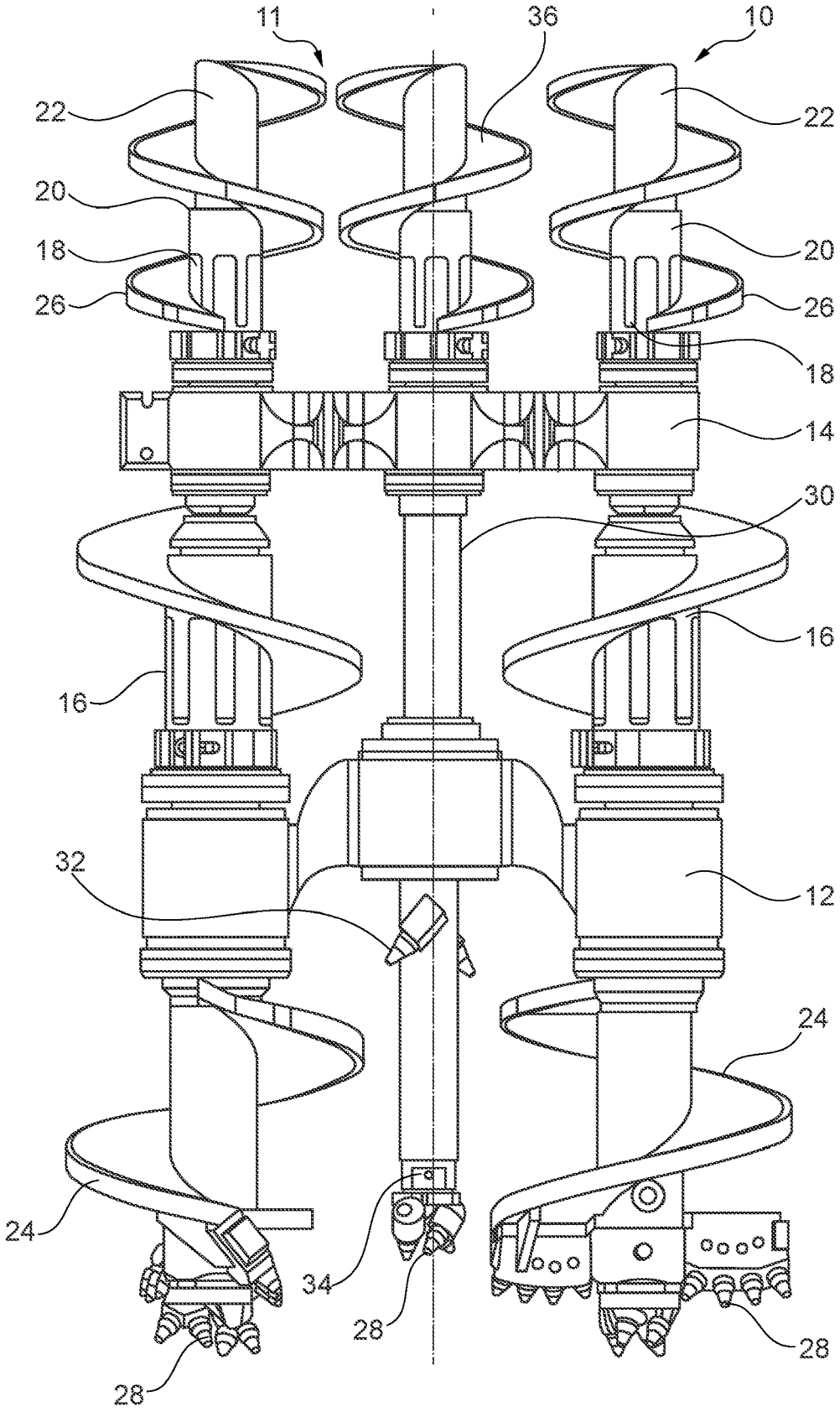
11
36
10
22
22
20
20
18
26
26
18
14
30
16
16
32
12
24
24
34
28
28
28

GROUND-WORKING MACHINE AND METHOD FOR PRODUCING WALL PANELS

The invention relates to a ground-working machine having at least two elongate drilling and mixing tools arranged parallel to each other, which comprise a rod-form base body, on which a first screw conveyor and at least one second screw conveyor are arranged, the second screw conveyor being axially spaced apart from the first screw conveyor.

The invention further relates to a method for producing wall panels in a ground with at least two elongate drilling and mixing tools arranged parallel to each other, which have a lower first screw conveyor and at least one upper second screw conveyor, wherein the drilling and mixing tools are driven in rotation and lowered into the ground, wherein ground material is removed and the ground material removed is mixed with an added binder suspension to form a ground mortar, which sets to form the wall panel after the drilling and mixing tools have been pulled out of the ground.

BACKGROUND

Such a ground-working machine and such a method follow from EP 2 395 153 B1 or DE 102 38 646 B3. With these known methods, vertical wall panels can be created very effectively in the ground, wherein they can form a vertical sealing or supporting wall by overlapping.

In order for the thus created walls to achieve an adequate sealing function, the individual wall panels must be created with a very exact position relative to each other. To produce relatively deep, vertical walls, drilling and mixing tools are to be used that have a corresponding length. With increasing length of the drilling and mixing tools, the risk of the drilling and mixing tools going off course as they are lowered into the ground also increases. This can impair not only the sealing function of the whole wall. Rather more, the individual rod-like drilling and mixing tools going off course can result in considerable shear and flexural forces being exerted on the typically 10 to 20 m long drilling and mixing tools. The dynamic stress during driving in rotation of the tools leads, if the tools go off course, to considerable wear and tear on the screw conveyors, the rod-form base body as well as the rotary bearings of the individual tools.

By arranging a transverse yoke and an intermediate guide, as taught in EP 2 395 153 B1, the stiffness of the whole tool can be increased and the extent of an off-course movement thus reduced. When shear forces arise during drilling, for example due to rocks or boulders in the drilling channel, the whole assembly can also be deflected. In this case the wear and tear on the screw conveyors, the rod-form base bodies and the bearings are distributed across the entire drilling and mixing tools.

SUMMARY

It is the object of the invention to indicate a ground-working device and a method for producing wall panels, with which wall panels can be produced efficiently and with low wear and tear.

The ground-working machine according to the invention is characterised in that at least on one drilling and mixing element at a lower end the first screw conveyor is formed with an outer diameter that is greater than an outer diameter of the second screw conveyor lying above the first screw conveyor.

According to a first aspect of the invention the lower first screw conveyor is provided with a larger outer diameter, through which the bore diameter of the bore created is determined. It is advantageous according to a finding of the invention that the second screw conveyor lying above, which is used primarily for transporting and mixing the ground material removed, has a smaller diameter. The second screw conveyor does not therefore come into frictional contact, or hardly comes into frictional contact, with the bore wall as the bore is drilled out. Even if the rod-form drilling and mixing tool goes off course, the upper second screw conveyor does not necessarily directly come into a wear-causing frictional contact with the bore wall.

The different design of the first screw conveyor and the second screw conveyor thus leads to a reduction of the friction wear on the second screw conveyor and correspondingly also to a reduction of the shear forces acting on the rod-form base body and on the rotary bearings.

In principle the first screw conveyor can be formed with any desired length. In a preferred embodiment, however, the lower first screw conveyor has half to two spiral rotations, preferably one single spiral rotation. The axial length of the lower first screw conveyor thus remains relatively small, so that the friction wear arising there is also low. The design of a half to two spiral rotations is sufficient for the function of the first screw conveyor for reliable upward transport of ground material that has been removed from the drilling site.

In a further preferred variant of the invention at least one transverse yoke is arranged between the lower first screw conveyor and the upper second screw conveyor, the transverse yoke connecting the drilling and mixing tools to each other. In particular two or more yokes can also be provided. At least one transverse yoke is thereby arranged directly above the first screw conveyor. Good stiffening is thus achieved and the risk of the whole tool assembly going off course is reduced.

It is preferable that the portions are brought together with the lower first screw conveyors of the at least two drilling and mixing tools via at least one transverse yoke to form an exchangeable unit, which can be connected in a releasable and rotationally fixed way via releasable connecting means respectively to the rod-form base bodies of the second screw conveyors lying above. The drilling and mixing tools can thus be simply exchanged with the removal means.

A particularly good stiffening of the whole arrangement is achieved according to one variant by the drilling and mixing tools being mounted rotatably in the at least one transverse yoke.

Furthermore it is advantageous according to one variant of the invention that mixing and/or agitating elements are additionally arranged at least in the area of the upper second screw conveyor. The mixing and agitating elements can be formed for example by paddles, bars or other mechanical agitating members. The second screw conveyor can be formed by a plurality of sub-parts. The individual, preferably radially extending mixing and/or agitating elements can thus be attached to the rod-form base body between the individual sub-parts of the screw conveyors. Through these mixing and agitating elements a particularly good mixing can be achieved between the removed ground material and an added binder suspension to form the ground mortar.

It is advantageous for good drilling progress according to a refinement of the invention that a removal means for removing ground material is attached to a lower tip of the drilling and mixing tools. The removal means can have one or a plurality of removal teeth. The removal means preferably extends from a middle area radially outwards. The removal means can preferably extend over the whole bore diameter.

To form overlapping bores for the formation of wall panels with an oval cross-section that have as far as possible equal widths, it is advantageous according to one refinement of the invention that two drilling and mixing tools are provided, between which a rod-form intermediate element is arranged, which has a screw conveyor in its upper area. An outer diameter of the screw conveyor of the intermediate element can be smaller than or equal to the outer diameter of the upper second screw conveyor of the neighbouring mixing and drilling tools.

It is particularly advantageous according to one variant of the invention that the intermediate element has, at least in its lower area, a smaller outer diameter than the neighbouring drilling and mixing tools. In particular the lower area of the intermediate element can be free from a lower screw conveyor. Optionally, individual mixing and/or agitating elements can be arranged in the lower area of the intermediate element. At a lower tip of the intermediate element a removal means can be provided for removing ground material in the intermediate area between the neighbouring drilling and mixing tools. The intermediate element and/or the rod-form base bodies can be formed as pipes, via which binder suspension is added into the bore.

A preferred variant of a ground-working machine according to the invention is characterised in that a mast is provided, along which a carriage is movably guided, on which the drilling and mixing tools are rotatably mounted. With the carriage, the drilling and mixing tools can be moved together as one tool unit.

It is advantageous according to a refinement that at least one rotary drive is arranged on the carriage for rotary driving of the drilling and mixing tools. The rotary drive is preferably a hydraulic motor.

A particularly efficient operation is achieved according to a refinement of the invention in that a drivable carrier unit is provided. The carrier unit is in particular a crawler-type vehicle with an upper structure rotatably mounted thereon, on which the vertically orientated mast is mounted with the tool unit.

The method according to the invention is characterised in that, by means of the lower first screw conveyor, on at least one drilling and mixing tool, a bore diameter is produced that is greater than an outer diameter of the upper second screw conveyor, wherein the upper second screw conveyor is spaced apart from a bore wall. A ground-working machine is preferably used, as previously described.

With the method according to the invention, wall panels can be produced in the ground efficiently. The wear arising on the drilling and mixing tools as well as the ground-working machine as a whole is kept low. The second screw conveyor having a smaller diameter is sufficient in order to mix the ground mortar and to hold the solid parts in suspension. Through the spacing from the wall, an annular channel is formed around the second screw conveyor, which channel promotes an advantageous circulation in the bore. A diameter difference can be between 5 cm and 50 cm, preferably in the region of from approximately 20 cm.

DESCRIPTION OF THE FIGURE

The FIGURE shows a front view of a lower part of a ground-working machine.

DETAILED DESCRIPTION

The invention is described in more detail below with the aid of a preferred exemplary embodiment, which is shown schematically in the drawing. The single drawing shows a front view of a lower part of a ground-working machine 10 according to the invention.

The ground-working machine 10 according to the invention is constructed, with respect to the carrier unit that is not shown, with a mast, as known from EP 2 395 153 B1. Along the mast (not shown), in the ground-working machine 10 according to the invention, a tool unit 11 with two elongate drilling and mixing tools 20 is mounted so that it can be moved vertically. A central, rod-form intermediate element 30 is arranged between the two parallel orientated drilling and mixing tools 20.

In the lower area shown, the two drilling and mixing tools 20 with the intermediate element 30 are coupled to each other via a lower first transverse yoke 12 and an upper second transverse yoke 14. In the first transverse yoke 12 and the second transverse yoke 14, the drilling and mixing tools 20 as well as the rod-form intermediate element 30 are each mounted rotatably via rotary bearings.

In their lower area below the first transverse yoke 12, the two drilling and mixing tools 20 each have a lower first screw conveyor 24 on their rod-form base body 22. The first screw conveyor 24 thereby extends from a removal means 28 with ground removing teeth via a winding as far as the lower end of the first transverse yoke 12. In an upper area above the second transverse yoke 14, the two drilling and mixing tools 20 each have an upper second screw conveyor 26, which each have a plurality of windings. According to the invention an outer diameter of the lower first screw conveyor 24 is greater than an outer diameter of the upper second screw conveyor 26.

Through the removal means 28 at the lower tips of the drilling and mixing tools 20, together with the lower first screw conveyor 24, a respective bore with a first bore diameter is created in the ground. Due to the larger outer diameter of the lower first screw conveyor 24, the upper second screw conveyors 26 with a smaller diameter do not contact the bore wall during drilling. Friction while drilling the bore is thus avoided, which has a positive effect on the drive power and the friction wear on the drilling and mixing tools 20.

In order to interconnect the two bores formed by the drilling and working tools 20 spaced apart from each other to form an approximately oval drilling cross-section, the rod-form intermediate element 30 is also provided at its lower end with a removal means 28 with removal teeth. In its lower area the intermediate element 30 is held free from a screw conveyor. In an intermediate area between the first transverse yoke 12 and the second transverse yoke 14, further removal teeth 32 are arranged, which extend approximately radially relative to the axis of rotation of the intermediate element 30 outwards and downwards.

In an upper area above the second transverse yoke 14 a tubular base body of the rod-form intermediate element 30 is provided with a screw conveyor 36. The screw conveyor 36 can have the same rotating direction and design as the second screw conveyor 26 of the drilling and mixing tool 20 on the right, whereas the second screw conveyor 26 of the drilling and mixing tool 20 on the left has an opposing spiral rotation. By means of at least one outlet opening 34 at the lower end of the tubular intermediate element 30, a binder suspension can be introduced, from outside the borehole, into the bore preferably under pressure. Through the rotating movement of the drilling and mixing tools 20 and the intermediate element 30, the ground material removed is mixed with the binder suspension, wherein a ground mortar is formed that sets. After withdrawal of the tool unit 11 from the borehole, the ground mortar can set to form a wall panel for a support or sealing wall.

The area of the lower first screw conveyor 24 with the removal means 28 of the two drilling and mixing tools 20 is attached via a first connecting means 16 releasably to the rod-form base bodies 22. The first connecting means 16 is an axial shaft connection with spline groove teething. This lower area is connected via the first transverse yoke 12 with each other and constitutes an exchangeable unit.

By means of a corresponding second connecting means 18 above the second transverse yoke 14, a further segment of the drilling and mixing tools 20 as well as the intermediate element 30 can be attached to the respective rod-form base bodies 22 in an easily releasable manner.

The invention claimed is:

1. A ground-working machine having at least two elongate drilling and mixing tools arranged parallel to each other, which comprise a rod-form base body, on which a lower first screw conveyor and at least one upper second screw conveyor are arranged, the at least one upper second screw conveyor being axially spaced apart from the lower first screw conveyor, wherein on at least one of the at least two elongate drilling and mixing tools, at a lower end of the lower first screw conveyor, the lower first screw conveyor is formed with an outer diameter that is greater than an outer diameter of the at least one upper second screw conveyor, which is arranged above the lower first screw conveyor, a first transverse yoke and a second transverse yoke are arranged between the lower first screw conveyor and the at least one upper second screw conveyor, the first transverse yoke and the second transverse yoke connecting the at least two elongate drilling and mixing tools to each other, between the at least two elongate drilling and mixing tools, a rod-form intermediate element is arranged, which has a third screw conveyor in an upper area of the rod-form intermediate element, the intermediate element has, at least in a lower area of the intermediate element, a smaller outer diameter than an outer diameter of the neighboring at least two elongate drilling and mixing tools, in a space between the first transverse yoke and the second transverse yoke, the at least two elongate drilling and mixing tools comprise a fourth screw conveyor, the intermediate element does not comprise a screw conveyor in the space between the first transverse yoke and the second transverse yoke, and the fourth screw conveyor has a diameter greater than that of the at least one upper second screw conveyor, and the lower area of the intermediate element is connected via the first transverse yoke and forms an exchangeable unit, which is releasably connected by an axial shaft connector.

2. The ground-working machine according to claim 1, wherein the lower first screw conveyor has a half to two spiral rotations.

3. The ground-working machine according to claim 2, wherein the lower first screw conveyor has a single spiral rotation.

4. The ground-working machine according to claim 1, wherein the at least two elongate drilling and mixing tools are rotatably mounted in the first transverse yoke and the second transverse yoke.

5. The ground-working machine according to claim 1, wherein at least in an area of the at least one upper second screw conveyor, mixing elements, agitating elements, or a combination of mixing elements and agitating elements are additionally arranged.

6. The ground-working machine according to claim 1, wherein a removal means for removing ground material is attached to a lower tip of the at least two elongate drilling and mixing tools.

7. The ground-working machine according to claim 1, wherein a mast is provided, along which a carriage is movably guided, and the at least two elongate drilling and mixing tools are rotatably mounted to the mast via the carriage.

8. The ground-working machine according to claim 7, wherein at least one rotary drive is arranged on the carriage for driving in rotation the at least two elongate drilling and mixing tools.

9. The ground-working machine according to claim 1, wherein a drivable carrier unit is provided.

10. A method for producing a wall panel in a ground with the ground-working machine according to claim 1, having the at least two elongate drilling and mixing tools arranged parallel to each other, which have the lower first screw conveyor and the at least one upper second screw conveyor, wherein the method comprises:

driving the at least two elongate drilling and mixing tools in rotation and sinking the at least two elongate drilling and mixing tools into the ground, removing ground material mixing the removed ground material with an added binder suspension and forming a ground mortar, and setting the ground mortar to form the wall panel after the at least two elongate drilling and mixing tools have been pulled out of the ground, wherein via the use of the lower first screw conveyor on at least one of the elongate drilling and mixing tools, a bore diameter is produced that is greater than an outer diameter of the at least one upper second screw conveyor, wherein the at least one upper second screw conveyor is spaced apart from a bore wall.

11. The ground-working machine according to claim 1, wherein the axial shaft connector comprises spline groove teething.

* * * * *